US006141830A

United States Patent [19]

Shimooka

[11] Patent Number: 6,141,830

[45] Date of Patent: Nov. 7, 2000

[54] OUTSET HINGE OF A DOOR

[76] Inventor: Nobuyuki Shimooka, 2-170-702, Nagatanaka, Higashiosaka-shi, Osaka 577, Japan

[21] Appl. No.: 09/088,898

[22] Filed: Jun. 2, 1998

[51] Int. Cl.[7] ..... E05D 7/02

[52] U.S. Cl. ..... 16/237; 16/245; 16/275; 16/282

[58] Field of Search ..... 16/236, 237, 238, 16/240, 242, 245, 260, 265, 271, 275, 276, 382, DIG. 43

[56] References Cited

U.S. PATENT DOCUMENTS

| | | | |
|---|---|---|---|
| 532,044 | 1/1895 | Fagan | 16/245 |
| 994,196 | 6/1911 | Reddick | 16/245 |
| 2,566,504 | 9/1951 | Soss | 16/275 |
| 2,839,778 | 6/1958 | Hutchinson et al. | 16/245 |
| 3,349,427 | 10/1967 | Cairns et al. | 16/382 |
| 3,599,275 | 8/1971 | Granzow | 16/275 |
| 4,604,769 | 8/1986 | Rock et al. | 16/382 |
| 4,785,498 | 11/1988 | Brotschi | 16/238 |
| 4,937,916 | 7/1990 | Redman | 16/245 |

FOREIGN PATENT DOCUMENTS

| | | | |
|---|---|---|---|
| 0196435 | 10/1986 | European Pat. Off. | 16/245 |
| 3004313 | 8/1981 | Germany | 16/245 |

*Primary Examiner*—Anthony Knight
*Assistant Examiner*—Mark Williams
*Attorney, Agent, or Firm*—Wenderoth, Lind & Ponack L.L.P.

[57] ABSTRACT

An outset hinge has a shaft holding body which is adjustable in a sideways direction. The side direction of the shaft holding body is equal to front and back directions or sideways directions of the door fittings. Accordingly the outset hinge is easy to adjust through the door fittings in the forward and backward directions or sideways directions.

2 Claims, 1 Drawing Sheet

OUTSET HINGE OF A DOOR

TECHNICAL FIELD

This invention relates to an easily adjustable outset hinge of a door.

BACKGROUND ART

A prior outset hinge of a door is not easy to adjust through the door fittings.

It is an object of the present invention to provide an outset hinge which is easy to adjust through the door fittings in forward and rearward directions.

It is another object of the present invention to provide an outset hinge which is easy to adjust through the door fittings in sideways directions.

SUMMARY OF THE INVENTION

In one aspect, the invention provides an outset hinge having a shaft holding body which is adjustable in a sideways direction. The sideways direction of the shaft holding body is equal to forward and backward directions or sideways directions of the door fittings.

Accordingly the invention provides an outset hinge which is easy to adjust through the door fittings in forward and backward directions or sideways directions.

The present invention thus has all of the advantages of an easily adjustable outset hinge of a door.

BRIEF DESCRIPTION OF THE DRAWINGS

The invention is further described with reference to the accompanying drawing, in which the FIGURE is an exploded perspective view of an outset hinge of a door according to the present invention.

DETAILED DESCRIPTION OF THE PREFERRED EMBODIMENT

Figure 1:
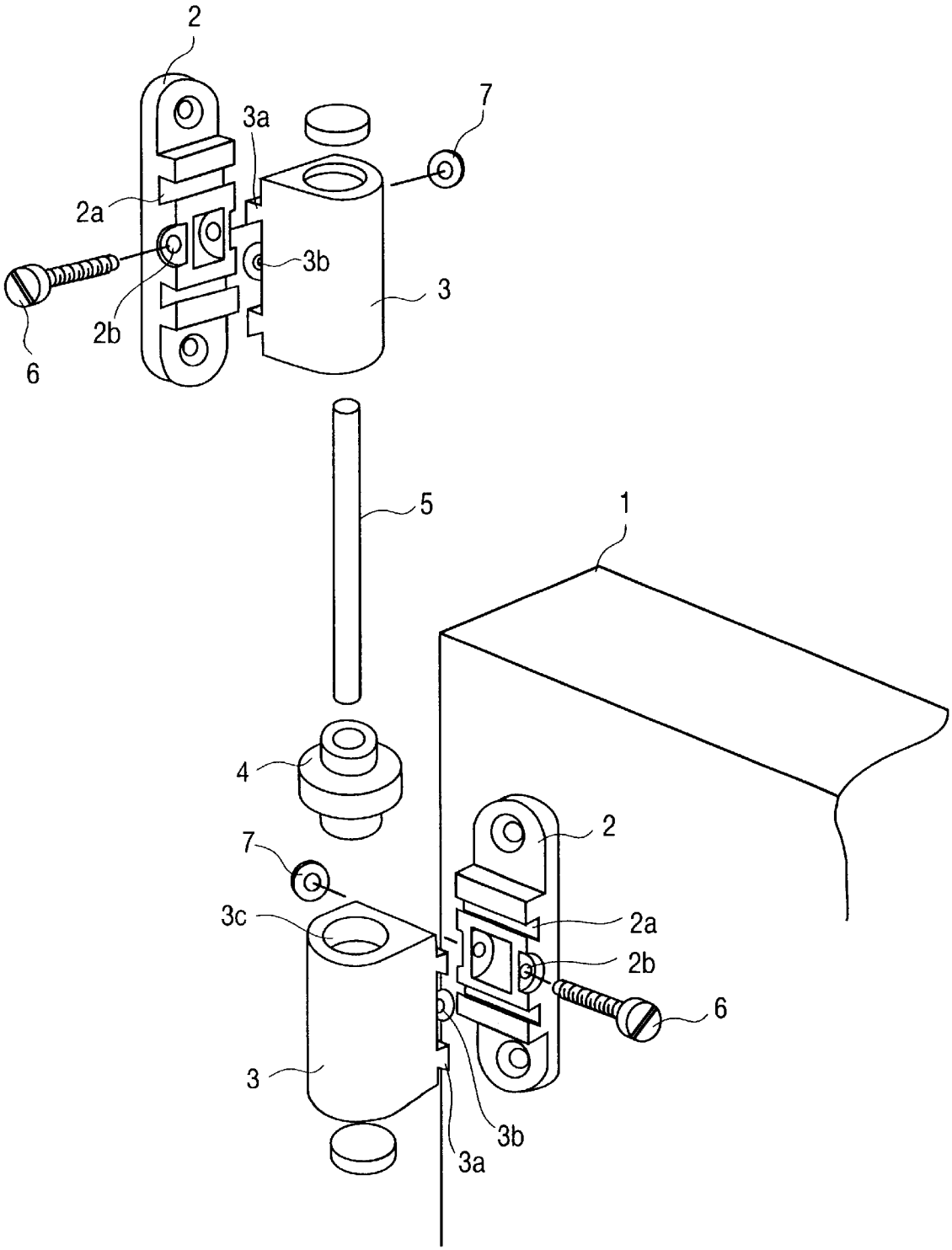

The stated object, other characteristics, and the present invention itself will be further understood by referring to the following description of an embodiment of the present invention taken in conjunction with the accompanying drawing.

In the FIGURE, an outset hinge of a door 1 according to the present invention has a pair of main bodies 2. Each main body 2 has a runway 2*a* running in side directions on a front face thereof. The main body 2 also has a hole 2*b* running parallel to the runway 2*a*.

The hole 2*b* of the main body 2 rotatably holds a screw 6 inserted therein. The screw 6 held in the hold 2*b* is confined in its axial direction by its head and a ring 7 fixed to the end of the screw 6. The ring 7 shown in the FIGURE is fixed by tightly fitting it, but an E-shaped ring 7 may also be adopted.

A shaft holding body 3 has a projected portion 3*a* which is to connect slidably to the runway 2*a* of the main body 2. The shaft holding body 3 also has a threaded hole 3*b* which is to connect to the screw 6. The shaft holding body 3 is slidably connected to the main body 2 in a sideways direction thereof. The shaft holding body 3 can be slidably moved in the sideways direction by turning the screw 6.

One main body 2 is fixed to the door 1 and the other main body 2 is fixed to a wall (not shown).

Two shaft holding bodies 3 are provided so that there is one for each main body. The bodies 3 are rotatably connected by a shaft 5. The shaft holding bodies 3 are axially spaced by a thrust bearing 4, furthermore. The shaft 5 penetrates through one shaft holding body 3, through the thrust bearing 4, and into the other shaft holding body 3.

The outset hinge of the illustrated embodiment operates as follows. The load of the door 1 acting on the shaft holding body 3 of the door 1 is supported by the other shaft holding body 3 of the wall. The load of the door acts in conditions of the door 1 being closed and while turning. The bearing 4 reduces friction between the two shaft holding bodies 3. When the fittings of the door 1 are to be adjusted, the screw 6 of the main body 2 is turned. When the screw 6 of the main body 2 of the door 1 is turned, the door 1 is adjusted in the sideways direction of the door 1. When the screw 6 of the main body 2 of the wall is turned, the door 1 is adjusted in forward and backward directions of the door 1.

What is claimed is:

1. An outset hinge in combination with a door and wall, comprising:

a first main body fixed to a door face of the door and a second main body fixed to the wall, said first main body having a front face;

a runway extending sideways on said front face of said first main body and extending, parallel to said door face;

a hole extending though said first main body parallel to said runway;

a shaft holding body having a projected portion that is slidably connected to said runway of said first main body, said shaft holding body having a threaded hole therein;

a screw inserted into said hole of said first main body and connected to said threaded hole of said shaft holding body; and a connection that pivotally connects said second main body to said shaft holding bode with a pivot shaft;

wherein said second main body comprises:

a second runway extending sideways on said front face of said second main body;

a hole extending though said second main body parallel to said second runway;

a second shaft holding body having a projected portion that is slidably connected to said second runway of said second main body, said second shaft holding body having a threaded hole therein; and a screw inserted into said hole of said second main body and connected to said threaded hole of said second shaft holding body;

wherein said connection comprises said pivot shaft extending through both said first and said second shaft holding bodies.

2. The outset hinge of claim 1, wherein said connection further comprises a thrust bearing located between said first and second shaft holding bodies.

* * * * *